US007052259B2

(12) United States Patent
Nachi

(10) Patent No.: US 7,052,259 B2
(45) Date of Patent: May 30, 2006

(54) VACUUM EXHAUSTING APPARATUS

(75) Inventor: Tsuyoshi Nachi, Mie (JP)

(73) Assignee: Teijin Seiki Co., Ltd., Tokyo (JP)

( * ) Notice: Subject to any disclaimer, the term of this patent is extended or adjusted under 35 U.S.C. 154(b) by 0 days.

(21) Appl. No.: 10/377,215

(22) Filed: Feb. 28, 2003

(65) Prior Publication Data

US 2003/0161749 A1 Aug. 28, 2003

(30) Foreign Application Priority Data

Feb. 28, 2002 (JP) ..... 2002-055097
Jul. 4, 2002 (JP) ..... 2002-196590

(51) Int. Cl.
*F03C 2/00* (2006.01)

(52) U.S. Cl. ..... 418/206.4; 418/46; 418/206.1

(58) Field of Classification Search ..... 418/46, 418/201.1, 206.4
See application file for complete search history.

(56) References Cited

U.S. PATENT DOCUMENTS 1,191,423 A * 7/1916 Holdaway ..... 418/201.1
1,635,271 A * 7/1927 Hapgood ..... 418/46
1,821,523 A * 9/1931 Montelius ..... 418/201.1
2,463,080 A * 3/1949 Beier ..... 418/206.6
2,705,922 A 4/1955 Rathman
3,289,600 A * 12/1966 Whitfield ..... 418/201.1
4,488,858 A 12/1984 Glanvall
4,923,374 A * 5/1990 Lundin et al. ..... 418/201.1
4,943,215 A * 7/1990 Berges ..... 418/46
5,655,782 A * 8/1997 Takabe et al. ..... 418/201.1
6,371,744 B1 * 4/2002 Mito et al. ..... 418/201.1
6,589,034 B1 * 7/2003 Vorwerk et al. ..... 418/206.4
6,769,890 B1 * 8/2004 Vigano' et al. ..... 418/201.1
6,884,050 B1 * 4/2005 Prior ..... 418/201.1

FOREIGN PATENT DOCUMENTS

EP 0 828 079 A2 3/1998
JP 7-12071 A 1/1995
JP 7-217563 A 8/1995
WO WO 99/49220 A1 9/1999
WO WO 99/54627 A1 10/1999

* cited by examiner

*Primary Examiner*—Theresa Trieu
(74) *Attorney, Agent, or Firm*—Akin Gump Strauss Hauer & Feld, LLP

(57) ABSTRACT

In a screw type vacuum pump which includes a housing provided with a rotor chamber, a pair of screw rotors in mesh with each other rotably provided in the rotor chamber, a transfer chamber of gas formed between an inner wall of the housing and flutes of the aforesaid pair of screw rotors, and a suction port and an exhaust port communicated to the transfer chamber, the gas being sucked from the suction port into the transfer chamber and exhausted from the exhaust port, by providing the aforesaid exhaust port in a side face of the housing, it is possible to form a larger exhaust port, and a time until the port is blocked with deposits can be prolonged.

27 Claims, 8 Drawing Sheets

VACUUM EXHAUSTING APPARATUS

BACKGROUND OF THE INVENTION

The present invention relates to an oil-free screw type vacuum pump, provided with a suction port and a discharge port, for discharging gas. The vacuum pump according to the present invention is preferably applicable to discharge such gas that is sucked from a process chamber during surface treatment in a process for manufacturing, for example, semiconductor products, electronic products and so on, and that contains gaseous components which may risk operation of the vacuum pump.

In the manufacturing process of the semiconductor products, there have been employed a chemical vapor deposition apparatus (CVD) for forming, on a surface of an object to be treated, a film such as a poly silicon film, a silicone nitride film, a silicone oxide film, etc., an etching apparatus for conducting surface treatment by flowing reaction gas, and so on.

The chemical vapor deposition apparatus (CVD), for example, includes a reaction chamber, a heater for heating this reaction chamber, a furnace port flange provided below this reaction chamber, a stock gas supply system connected to the furnace port flange, and an exhaust system connected to an upper part inside the reaction chamber. A silica boat carrying thereon a number of objects to be treated is arranged at a predetermined position in the reaction chamber, and the stock gas such as SiH4, SiH2Cl2, NH3, etc. is supplied to the reaction chamber under a reduced pressure and while heating, to form a reaction-formed film such as a poly Si film, a silicone nitride film, etc. on the objects to be treated.

In the above described chemical vapor deposition apparatus (CVD) and the etching apparatus, the gas required for producing the semiconductors has been supplied to a wafer which is arranged inside a vacuum chamber to conduct the treatment of the wafer. All the gas after the treatment in the vacuum chamber has been sucked from the vacuum chamber by means of a vacuum pump, and thereafter, has been exhausted to the atmosphere or to a treatment device through an outlet of the pump.

In the manufacturing process of the semiconductors, an oil-free dry vacuum pump has been employed so that oil molecules may not leak to a process chamber. Conventionally, as the vacuum pump for the apparatus for manufacturing the semiconductors, besides using singly the dry vacuum pump such as a screw type pump, a turbo molecule pump, etc., there has been employed a multi-step vacuum pump including a plurality of the pumps combined together to increase exhausting efficiency. As shown in FIG. 3, the screw type dry vacuum pump has two shafts 101, 102 held in parallel in a casing 100. Screw rotors 103, 104, which have screw grooves in mesh with each other, are fixed to the shafts 101, 102. One of the shafts, i.e. the shaft 101 is driven to rotate by means of a motor 105, and the rotation is transmitted to the other shaft 102 by way of a gear 106 which is provided at the end of the shaft 101. The casing 100 is provided with a suction port 107 and an exhaust port 108. With the above-described structure, by synchronously rotating the screw rotors 103, 104 in reverse directions, the gas enclosed between the screw rotors 103, 104 and the casing 100 is moved by the rotation in an axial direction and exhausted.

Function of the screw type vacuum pump includes a suction step of sucking the gas from the suction port 107 into the rotors, a transfer step of transferring the gas within the rotors, and a discharge step of discharging the gas from the exhaust port 108.

During these steps, formation of solid matters in the pump becomes a problem. Precipitation and formation of the solid matters may be carried out through chemical reactions between gas components to be exhausted by the pump, reactions of the gas components on a surface, and/or catalytic effects. Besides such chemical reactions, formation of the solid matters may occur also with a change of agglomeration state caused by a rise of pressure or cooling.

Moreover, the exhaust port 108 of the conventional screw type dry vacuum pump has been provided in a bottom part of the housing, as shown in FIG. 4, in order to increase exhausting efficiency. Therefore, because bearings 109 for rotatably fixing the screw rotors have been arranged in the bottom part, a sectional shape of the exhaust port has been restricted in size.

The suction port 107 has been provided in a ceiling portion of the casing 100 in order to increase a conductance because the vacuum pump, generally arranged vertically, is disposed just below the vacuum chamber.

In recent years, there has been a tendency for the apparatus for manufacturing the semiconductor to use a large amount of gas, because the wafer has become large-sized in diameter and a film of high quality has been aimed. Only a portion of the gas which has been introduced into the vacuum chamber in the apparatus for manufacturing the semiconductor has contributed to the reaction, and most of the remaining gas has been exhausted without reacting. All the remainder of the reaction-forming gas has passed through the vacuum pump, and the reaction-forming gas to be exhausted from the vacuum pump has been liable to coagulate in the exhaust port due to a rise of pressure. Especially, in the vacuum pump such as the screw type dry vacuum pump which has a function of exhausting by pressurizing the gas, the pressure of the reaction-forming gas has risen in the pressurizing process just before exhaustion, and solid products have been created because of a change of the coagulation state near the exhaust port. Conventionally, the exhaust port of the screw type dry vacuum pump has been generally provided in a bottom face at an exhausting side of the housing which contains the screws, and the gas has been exhausted from the bottom face. However, in case of exhausting the gas from the bottom face, it has been impossible to make a sectional area of the exhaust port large, because there has been provided a structure including the bearings for fixing the screw rotors and seal mechanisms for preventing a leak of lubricating oil to the exhaust chamber. For this reason, there has been such a problem that when the above described solid products have been adhered to the exhaust port and deposited there, the solid products may block the exhaust port in a short period, and possible working time of the vacuum pump may be decreased.

Further, with respect to the conventional exhaust port, it has been necessary to completely isolate the exhaust port from a lubricating chamber which has been filled with oil, and to form an exhaust passage for introducing the exhaust gas to the exterior of the vacuum pump. For this reason, the produced coagulum has adhered to an inner face of the exhaust passage, while the reaction-forming gas has flowed through the passage, and the sectional area of the exhaust port has been decreased, resulting in deterioration of exhausting ability. There has also been such a problem that because the exhaust passage having the narrow sectional area runs through the complicated structure including the bearings, the seal mechanisms for preventing a leak of the lubricating oil to the exhaust chamber, and so on, time for maintenance for removing these adhered deposits has become inevitably long.

The adhesion of the produced coagulum has occur also on the portion of the housing in the vicinity of the suction port.

SUMMARY OF THE INVENTION

The present invention has been made to solve the above described problems, and an object of the invention is to provide a screw type vacuum pump which can remove restriction of working time due to a defect caused by block of an exhaust passage, etc., because reaction products produced by solidification of reaction-forming gas have been deposited, and which can lengthen a maintenance period.

According to the invention, in a screw type vacuum pump which includes a housing provided with a rotor chamber, a pair of screw rotors in mesh with each other rotably provided in the rotor chamber, a transfer chamber of gas formed between an inner wall of the housing and flutes of the aforesaid pair of screw rotors, and a suction port and an exhaust port communicated to the transfer chamber, the gas being sucked from the suction port into the transfer chamber and exhausted from the exhaust port, the aforesaid exhaust port is provided in a side face of the housing.

By constructing in this manner, the defect of the conventional art that because the exhaust port has been provided in the bottom of at the exhausting side of the housing, an area of the exhaust port has been restricted because there have been provided the bearings for supporting the screw rotors, the seal mechanisms for preventing a leak of the lubricating oil to the exhaust chamber, and so on will be eliminated, and it will be possible to make a larger hole as compared with the area of the conventional exhaust port. Accordingly, it is possible to prolong the time until products are deposited and block the hole to an extent that performance of the vacuum pump is deteriorated. As the results, maintenance period for removing the products deposited on the exhaust port can be prolonged. In other words, continuous operating time of the vacuum pump can be extended. Moreover, it is unnecessary to provide an exhaust passage for exhausting the gas to the exterior of the pump, and therefore, deposition of the products in the exhaust passage near the exhaust port can be eliminated.

The invention is characterized in that the aforesaid exhaust port formed in the side face of the housing is shaped to have a smaller area than the transfer chamber which is formed between an inner wall of the housing and flutes of the aforesaid screw rotors. By constructing in this manner, the area of the hole of the exhaust port in the side face of the housing can be made larger with hardly deteriorating performance of the vacuum pump.

The invention is characterized in that the exhaust port is positioned in an endmost part at an exhausting side of the screw rotors. By constructing in this manner, the products deposited on the exhaust port can be easily removed on occasion of maintenance, and further, the deposits on the bottom in the housing can be also easily removed.

The invention is further characterized in that a part of the aforesaid exhaust chamber is connected to the exhaust port, after a lower end face of the aforesaid transfer chamber has reached a lower end face at an exhausting side of the rotors. By constructing in this manner, the area of the hole of the exhaust port in the side face of the housing can be made larger with hardly deteriorating performance of the vacuum pump.

According to the invention, in a screw type vacuum pump which includes a housing provided with a rotor chamber, a pair of screw rotors in mesh with each other rotably provided in the rotor chamber, a transfer chamber of gas formed between an inner wall of the housing and grooves of the aforesaid pair of screw rotors, and a suction port and an exhaust port communicated to the transfer chamber, the gas being sucked from the suction port into the transfer chamber and exhausted from the exhaust port, the aforesaid suction port is provided in a side face of the housing. The side face is confronted with the screw rotors in a direction perpendicular to axes of the screw rotors. By this arrangement, the maintenance work is made easy. Further, it is possible to prevent a bulk of reaction-forming products, generated within a vacuum chamber, from dropping into an exhaust chamber, without increase in axial length of the vacuum pump and without decrease in conductance.

The invention is characterized in that an opening area of the suction port is equal to or less than (preferably, substantially equal to) an area of the transfer chamber. Accordingly, since a flow speed of gas can be reduced as the area of the suction port is increased, it is possible to prevent the bulk of the reaction-forming products, which has dropped in the vicinity of the suction port, from entering into the exhaust chamber due to the high speed gas flow.

The invention is characterized in that the suction port is at least partially located at a position where the suction side end portion of the screw rotor is located. Accordingly, the suction port can be located in the side face of the housing beyond the exhaust chamber defined by the housing and the screw rotors (i.e. the suction portion can be located in the end portion of the housing where the exhaust chamber is not formed). This arrangement makes the opening of the suction port larger to prevent clogging of the suction port by the reaction-forming products.

The invention is characterized in that the shape of the suction port is such that the communication between the transfer chamber and the suction port is interrupted prior to a time point at which the transfer chamber is closed by teeth portions of the suction side end surfaces of the screw rotors. By this arrangement, it is possible to most effectively prevent a reverse flow from the gas-exhaust side using screw turns of the screw rotors.

The invention is characterized in that a trap is attached to the suction port. The trap prevents the products from entering into the meshing portions of the screw rotors even if the bulk of the products is sucked along the gas flow. The trap may be a mesh that covers the suction port, a groove that is disposed in a pipe or a portion in the vicinity of the suction port, etc. In case that the trap is detachable, the products collected therein or thereby can be easily removed without disassembly of the pump.

The invention is characterized in that the suction port and the exhaust port are formed in opposite surfaces of the housing. By this arrangement, the suction port and the exhaust port are arranged opposite from each other in a direction perpendicular to the axes of the screw rotors, and accordingly, it is possible to avoid the increase in the axial length of the vacuum pump arranged vertically.

The present disclosure relates to the subject matter contained in Japanese patent application No. 2002-55097 (filed on Feb. 28, 2003) and 2002-196590 (filed on Jul. 4, 2003), each of which is expressly incorporated herein by reference in its entirety.

DESCRIPTION OF THE PREFERRED EMBODIMENT

Figure 1:
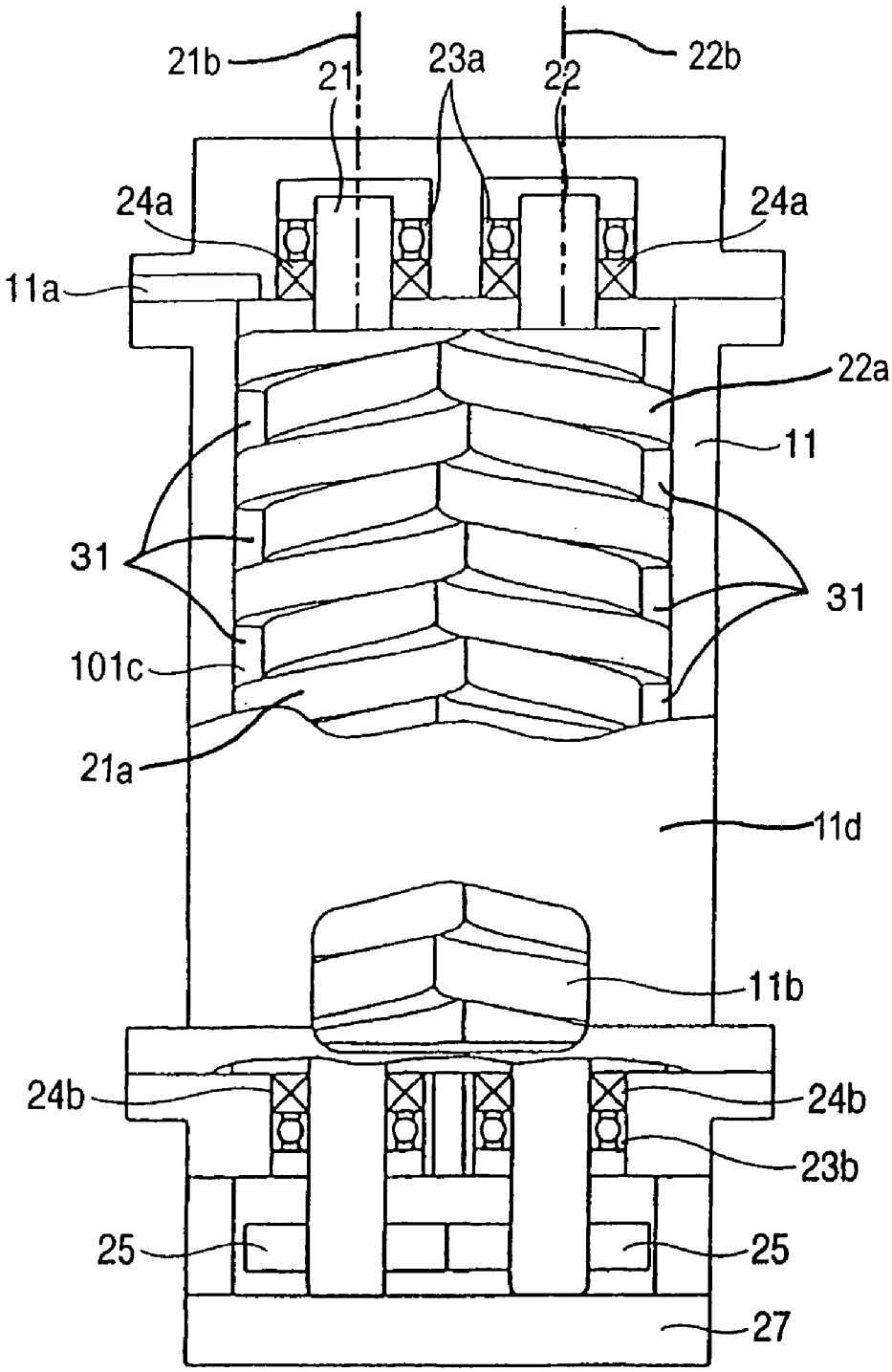
FIG. 1 is a sectional front view of an essential part of a vacuum exhausting apparatus according to a first embodiment of the invention.
Figure 2:
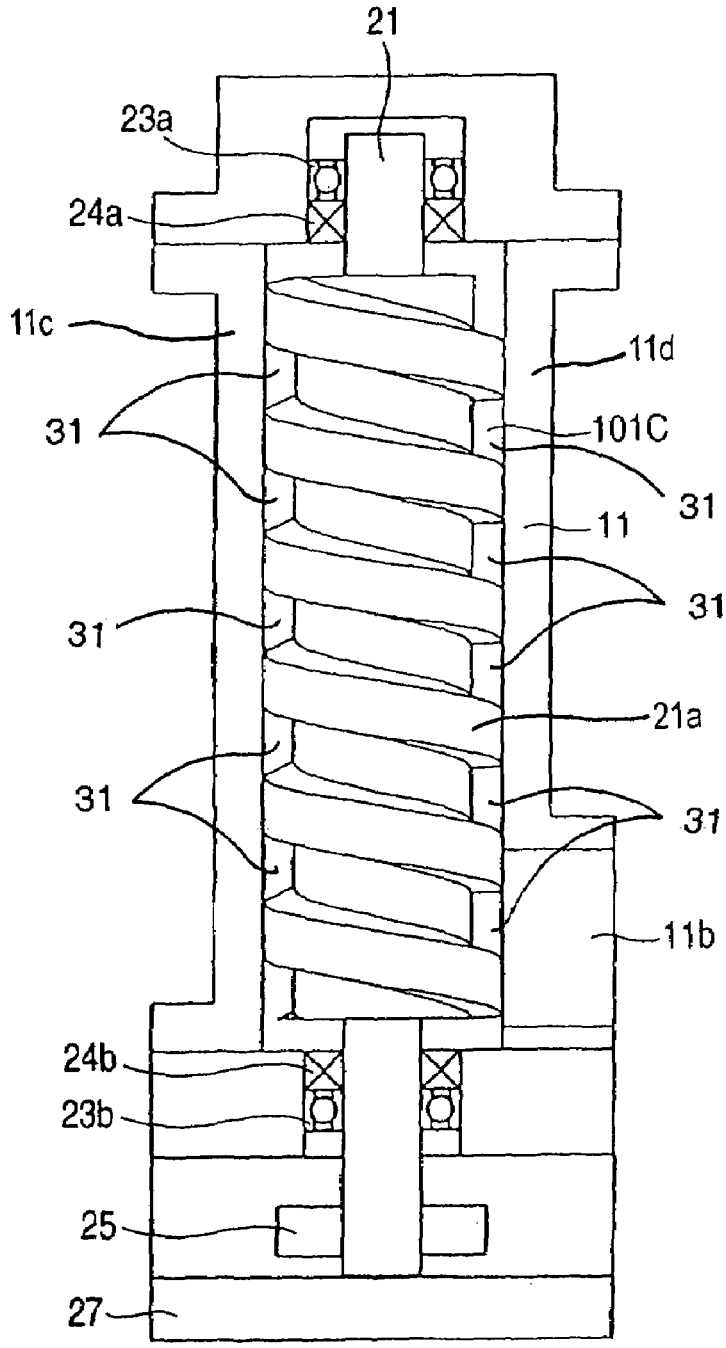
FIG. 2 is a sectional side view of the essential part of the vacuum exhausting apparatus according to the embodiment of the invention.
Figure 3:
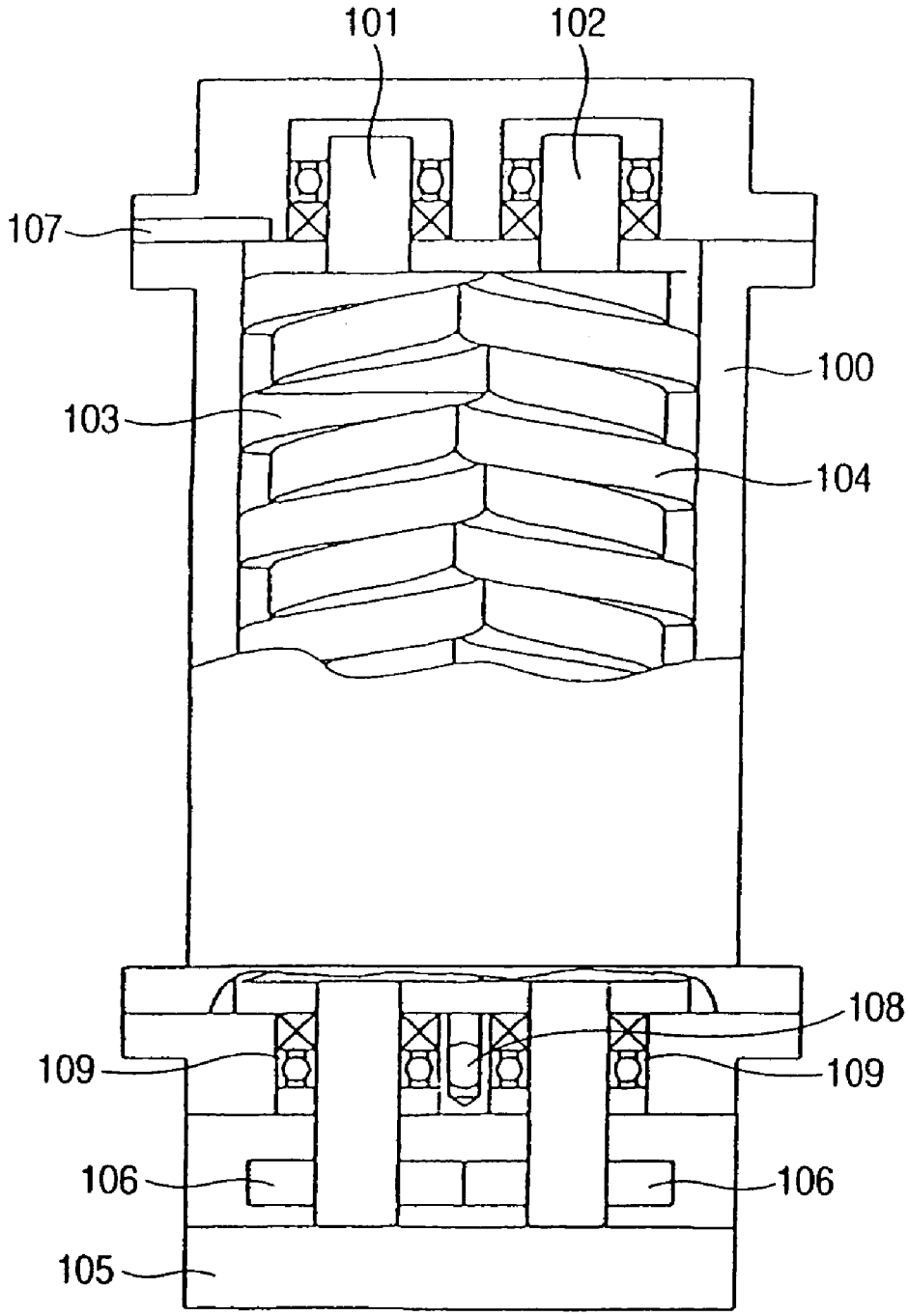
FIG. 3 PRIOR ART
FIG. 3 is a sectional front view of an essential part of a vacuum exhausting apparatus according to a conventional embodiment.
Figure 4:
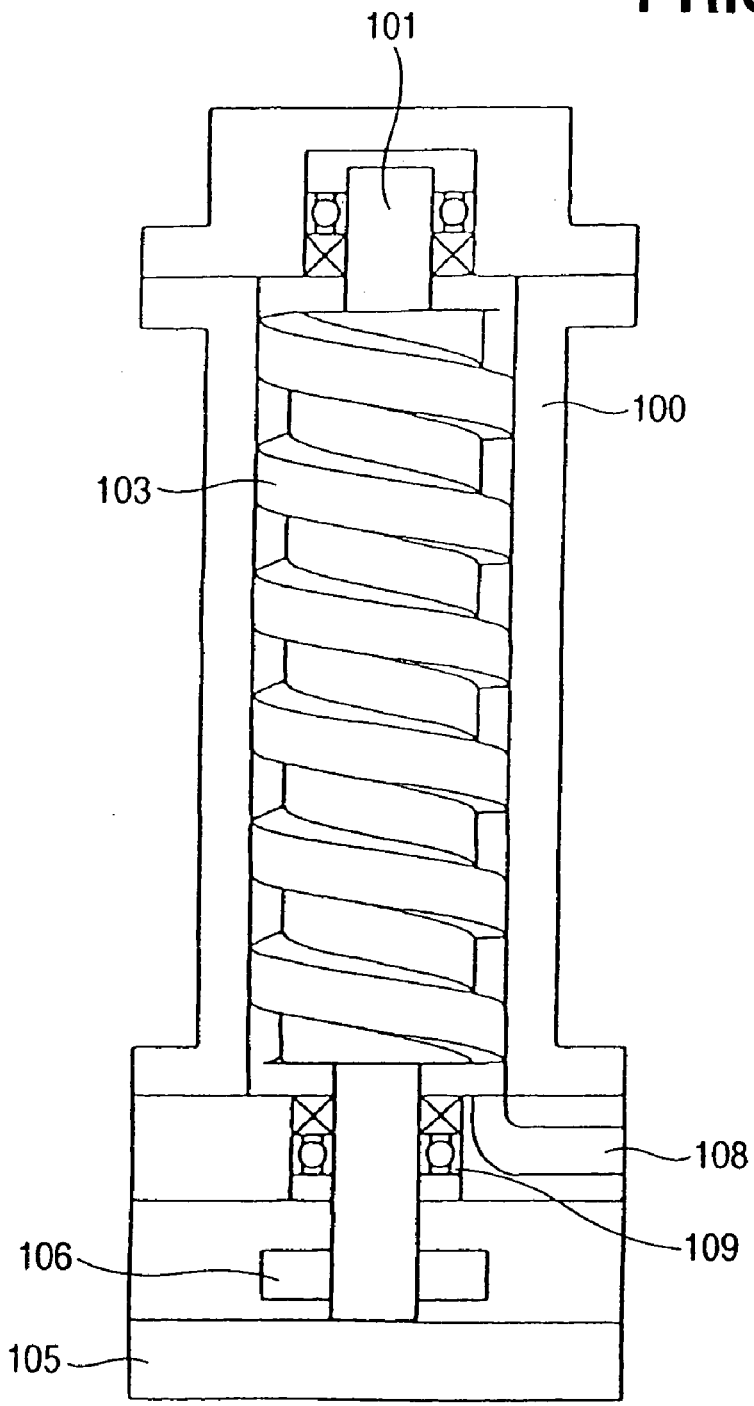
FIG. 4 PRIOR ART
FIG. 4 is a sectional side view of the essential part of the vacuum exhausting apparatus according to the conventional embodiment.

Now, preferred embodiments of the invention will be described referring to the drawings. FIGS. 1 and 2 are views showing a screw type dry vacuum pump according to a first embodiment of the invention.

FIGS. 1 and 2 are a sectional front view and a sectional side view of an essential part schematically showing an inner structure of the vacuum pump in this embodiment. The vacuum pump includes a housing 11 having a first side face 11*c*, a second side face 11*d* opposite from the first side face 11*c*, and a rotor chamber between the first and second side faces 11*c*, 11*d*. The housing 11 is provided with a suction port 11*a* and an exhaust port 11*b*, a female and a male screw rotors 21, 22 which are contained in parallel so as to be meshed with each other in non contact meshed manner, leaving a predetermined clearance (a minute gap) in the housing 11, bearings 23*a*, 23*b* which are interposed between the housing 11 and the screw rotors 21, 22, seal members 24*a*, 24*b* for sealing axial bores, a synchronous gears 25 integrally mounted to the screw rotors 21, 22 so as to synchronously rotate the rotors 21, 22 in reverse directions, and a drive unit, such as a motor, 27 connected to one end of the rotor 22. Each of the screw rotors 21, 22 have at least one thread 21*a*, 22*a* extending at least 720 degrees therearound.

The female screw rotor 21 and the male screw rotor 22 have such an outer diameter and an axial length as leaving the predetermined clearance, for example, of 50 micron, with respect to an inner wall face of the housing 11. Between the housing 11 and the screw rotors 21, 22, there are formed operation chambers 31 in a shape of a plurality of spirals which are partitioned from each other by the meshed parts of the screw rotors 21, 22, and adapted to be transferred in an axial direction of the rotation axis along with the rotation of the screw rotors 21, 22.

These operation chambers 31 are increased in their capacity along with the rotation of the screw rotor 21, 22 in a transfer section at the left end side in FIG. 1, and are communicated with the suction port 11*a* of the housing as shown in FIG. 2 while increasing the capacity. The operation chambers 31 are transferred to the right side in the drawing after the gas has been sucked, and the capacity is decreased in a transfer section at the right end side in FIG. 1. Then, in a section where the capacity of the operation chambers has become below a predetermined capacity after the gas has been pressurized, the operation chamber at the right end side in FIG. 1 is communicated with the exhaust port 11*b* to exhaust the gas.

By providing the exhaust port 11*b* in the second side face of the housing, as shown in the drawings, the area of the exhaust port can be made larger as compared with the case in which the exhaust port is provided in the bottom face of the housing. Preferably, the exhaust port 11*b* has a polygonal shape, and, more preferably, a pentagonal shape, as viewed in a direction perpendicular to axes 21*b*, 22*b* of the screw rotors 21, 22. Accordingly, it is possible to remarkably prolong the time until the exhaust port is blocked with the deposits which have been produced by the reaction forming gas. Moreover, in case where the exhaust port is provided in the bottom face, when the gas is exhausted to the exterior of the vacuum pump, it is necessary to provide the exhaust passage for completely separating it from a chamber filled with oil and provided with the bearings or the like. Therefore, the passage in which the deposits are piled becomes longer, and possibility of blocking the exhaust port and the exhaust passage will be increased. However, in case where a hole is formed in the side face of the housing, the exhaust passage in the exterior can be directly connected to the hole, and there will be no anxiety that the deposits may be piled in the exhaust passage inside the housing. Further, because the exhaust port is exposed from the housing of the pump, the deposits can be easily removed on occasion of maintenance, and the maintenance time can be decreased.

According to the aforementioned embodiment of the present invention, excellent advantage can be obtained as follows;

(1) As compared with the exhaust port provided in the bottom face as in the prior art, a larger hole can be provided. Therefore, even though the reaction forming gas flows to the exhaust port of the screw type dry vacuum pump and deposits are piled there, the time for the deposits to block the hole can be prolonged. As the results, the maintenance period can be prolonged, and accordingly, continuous operation can be made.

(2) Moreover, on occasion of maintenance, because the gas can be directly exhausted from the side face, as compared with the exhaust port arranged in the bottom face as in the prior art, even though deposits have been piled, the deposits can be easily removed and the maintenance time can be remarkably decreased.

Figure 5:
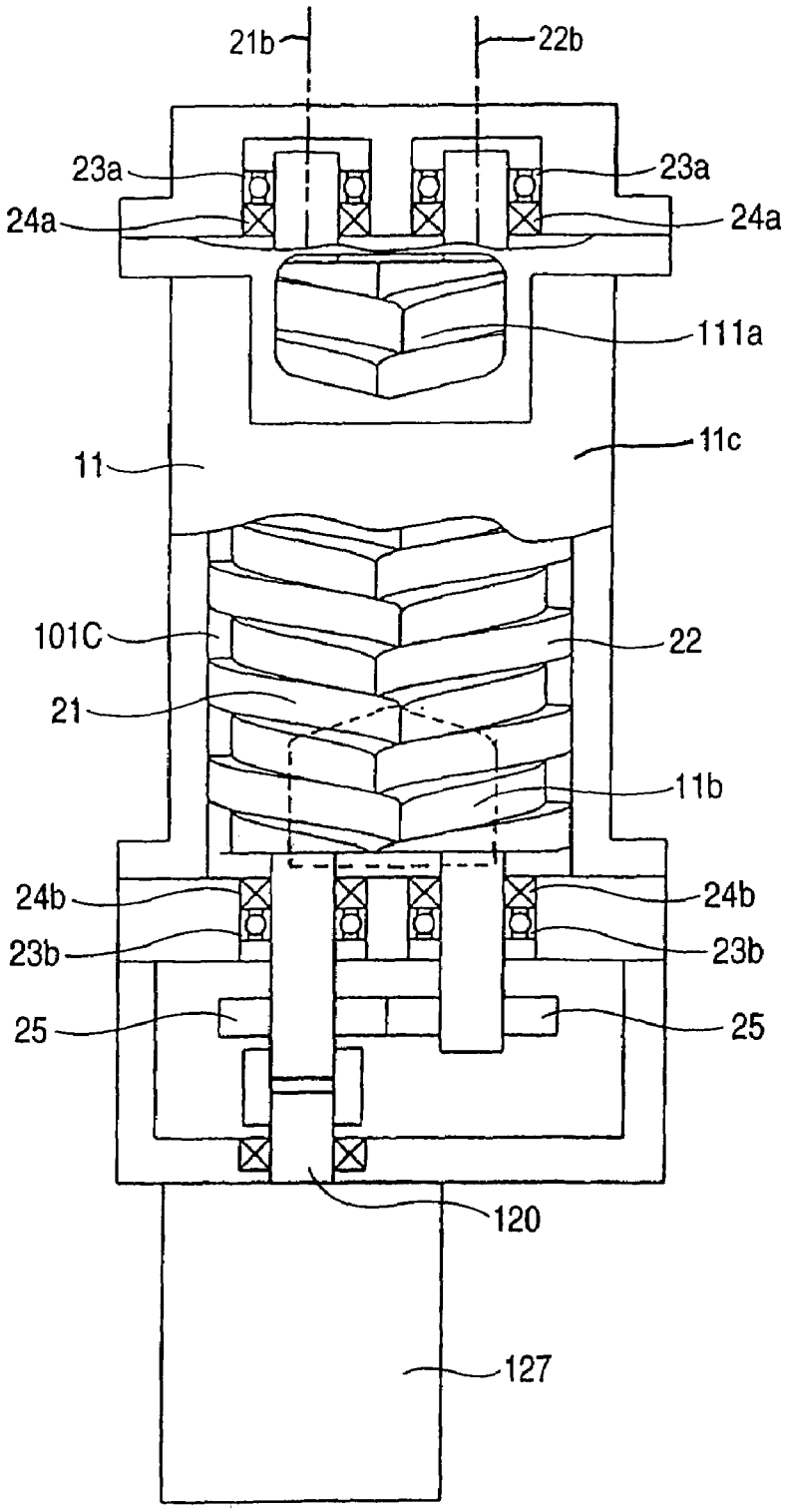
FIG. 5 is a sectional front view of an essential part of a vacuum exhausting apparatus according to a second embodiment of the invention.
Figure 6:
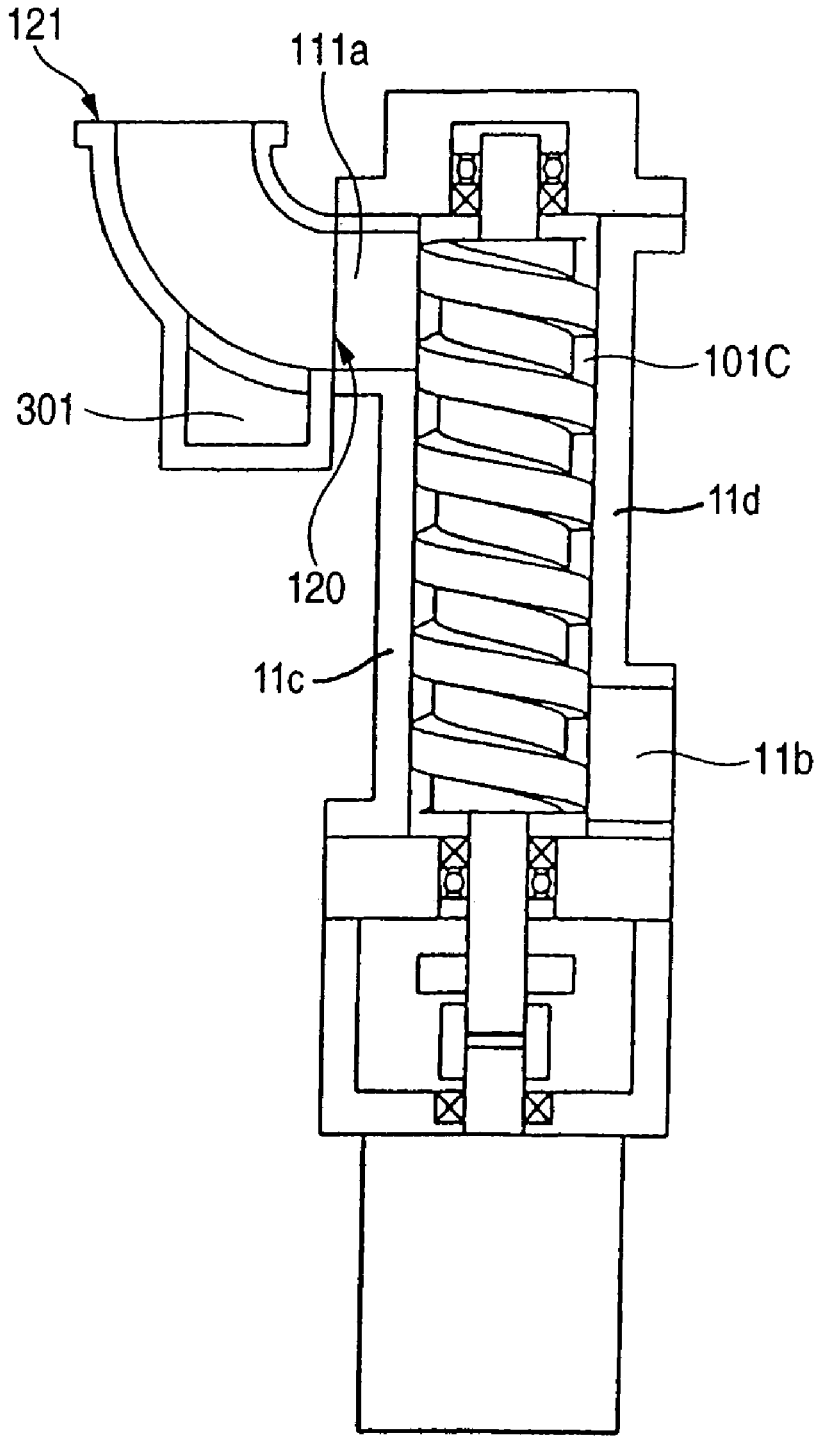
FIG. 6 is a sectional side view of the essential part of the vacuum exhausting apparatus according to the second embodiment of the invention.

The novel arrangement of the exhaust port as discussed in connection with the first embodiment is also applicable to the suction port. FIGS. 5 and 6 show a screw type dry vacuum pump according to a second embodiment of the invention, in which the novel arrangement of the exhaust port as discussed in connection with the first embodiment is used not only as the exhaust port but also as the suction port.

The suction port 111*a* is formed in the first side face of the housing 11. The side face is confronted with the screw rotors 21, 22 in a direction perpendicular to axes of the screw rotors 21, 22. That is, as shown in FIG. 6, the suction port 111*a* is formed at the uppermost portion of the side face of the housing 11 facing the screws of the screw rotors 21, 22. Even if the bulk of the reaction-forming products deposited on an inner wall of a suction pipe is peeled off therefrom to drop to the suction port 111*a*, the bulk of the reaction-forming products is prevented from directly dropping into the exhaust chamber. Accordingly, it is possible to clogging and stopping of the vacuum pump caused due to the bulk of the reaction-forming products entering into the exhaust chamber. The transfer chamber 101*c* is formed by the inner wall of the housing 11 and the meshing teeth of the screw rotors 21, 22. An opening area of the suction port 111*a* (and an opening area of the exhaust port 11*b*) is equal to or less than, preferably, substantially equal to, an area of the transfer chamber 101*c*. The area of the transfer chamber 101*c* means an area of one compartment where the one compartment corresponds to an amount to be transferred by one rotation of the screw rotors 21, 22 and the area is a projection area of the one compartment as viewed in a direction perpendicular to axes of the screw rotors 21, 22. The suction port 111*a* (the exhaust port 11*b*) is at least partially located at a position where the suction side end portion (the exhaust side end portion) of the screw rotor 21, 22 is located. That is, the suction port 111*a* (the exhaust port 11*b*) is located in the first side face (the opposite side face) of the housing 11 beyond the exhaust chamber defined by the housing 11 and the screw rotors 21, 22. The shape of the suction port 111*a* is such that the communication between the transfer chamber 101*c* and the suction port 111*a* is interrupted prior to a time point at which the transfer chamber 101*c* is closed by teeth of the suction side end surfaces of the screw rotors 21, 22. Preferably, the suction port 111*a* has a polygonal shape, and, more preferably, a pentagonal shape, as viewed in a direction perpendicular to axes 21*b*, 22*b* of the screw rotors 21, 22. A trap 120 in the form of a mesh is disposed on an inlet of the suction port 111*a* to prevent the bulk of the reaction-forming products from entering into the exhaust chamber along the flow of the exhaust gas flowing in the pipe 121 even if the bulk of the products drops into the pipe 121. An additional trap 301 in the form of a storage chamber or a storage groove for storing the reaction-forming products therein is disposed on the pipe 121 connected to the suction port 111*a* to prevent the entry of the reaction-forming products into the exhaust chamber. The trap 301 may be detachably fixed to the pipe 121 via an O-ring, for easier maintenance purpose, so that the products collected in the trap 301 can be easily removed.

The suction port 111*a* and the exhaust port 11*b* are symmetrically arranged with respect to a plane containing axes of the screw rotors 21, 22.

In addition, reference numeral 127 is a drive, such as a motor, which has a rotation shaft 120 connected to the screw rotor 21.

Figure 7:
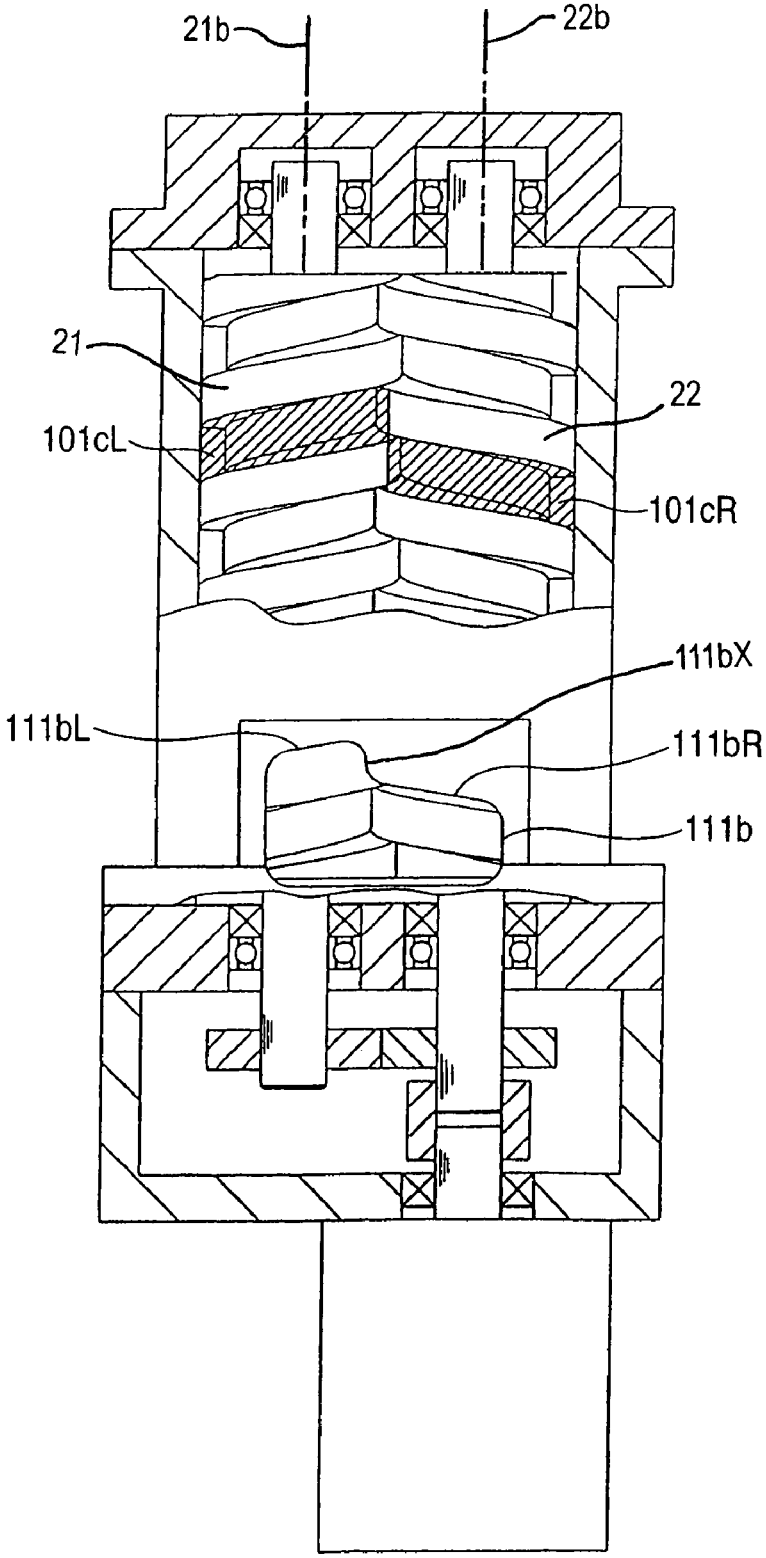
FIG. 7 is a sectional front view of an essential part of a vacuum exhausting apparatus according to a third embodiment of the invention.
Figure 8:
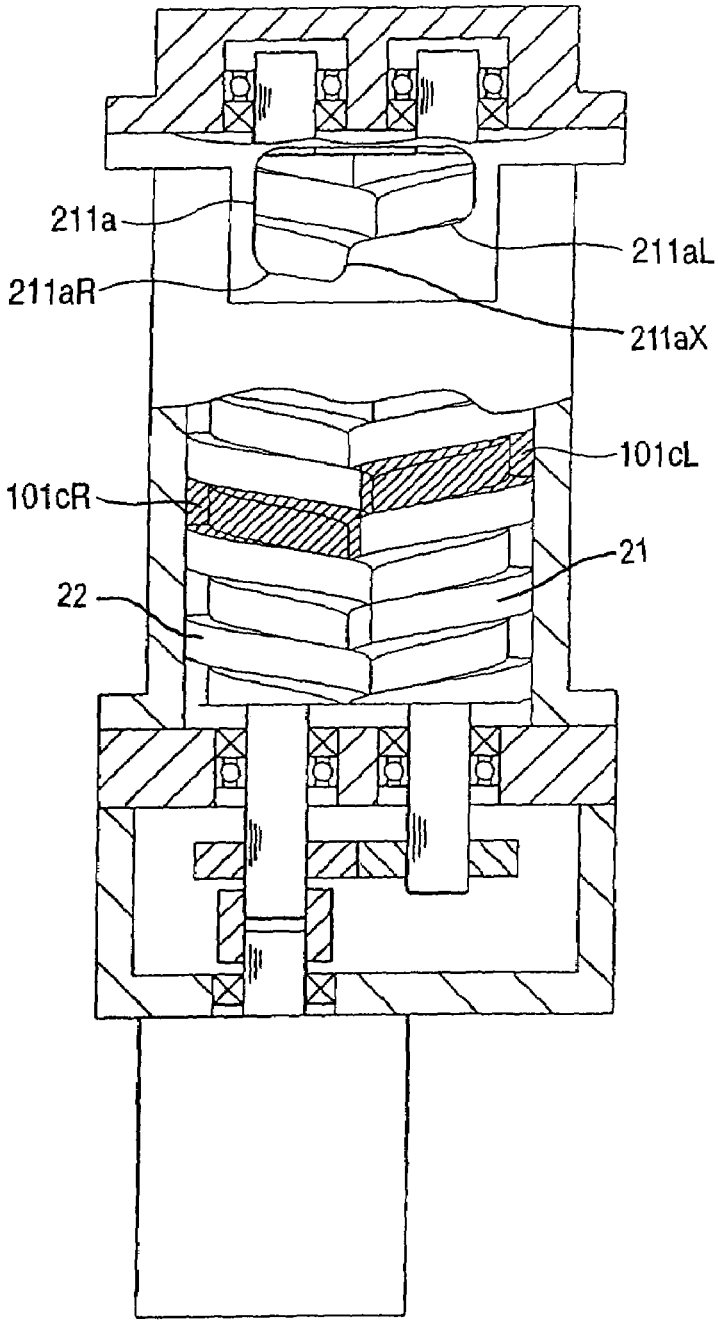
FIG. 8 is a sectional back view of the essential part of the vacuum exhausting apparatus according to the third embodiment of the invention.

FIGS. 7 and 8 show a screw type dry vacuum pump according to a third embodiment of the invention, which differs from the second embodiment only in shapes of the suction port 211*a* and the exhaust port 111*b*. At least one of the suction port 211*a* and the exhaust port 111*b* has a predetermined shape as viewed in the direction perpendicular to the axes of the screw rotors 21, 22. Said predetermined shape includes a first inclined part 211*a*L, 111*b*L extending substantially parallel to a direction in which said groove of one of said screw rotors 21 extends, and a second inclined part 211*a*R, 111*b*L extending substantially parallel to a direction in which said groove of the other of said screw rotors 22 extends. Preferably, the first inclined part 111*b*L, 211*a*L is offset from the second inclined part 111*b*R, 211*a*R by a step 111*b*X, 211*a*X in a direction parallel to a plane containing the axes 21*b*, 22*b* of the screw rotors 21, 22. In the third embodiment, as shown in FIG. 7, the first inclined part or an upper, left part 111*b*L extends along a shape of a left transfer chamber 101*c*L when the left transfer chamber 101*c*L is moved to the exhaust port 111*b*, and the second inclined part or an upper, right part 111*b*R extends along a shape of a right transfer chamber 101*c*R, just below the left transfer chamber 101*c*L, when the right transfer chamber 101*c*R is moved to the exhaust port 111*b*. By this arrangement, the communication of the exhaust port 111*b* with the left transfer chamber 101*c*L and the right transfer chamber 101*c*R is established simultaneously.

Further, as shown in FIG. 8, the first inclined part or a lower, left part 211*a*L extends along a shape of the left transfer chamber 101*c*L when the left transfer chamber 101*c*L is moved to the suction port 211*a*, and the second inclined part or a lower, right part 211*a*R extends along a shape of the right transfer chamber 101*c*R, just below the left transfer chamber 101*c*L, when the right transfer chamber 101*c*R is moved to the suction port 211*a*. By this arrangement, the communication of the suction port 211*a* with the left transfer chamber 101*c*L and the right transfer chamber 101*c*R is interrupted simultaneously.

Referring to FIGS. 1, 2, and 5–8, a length of at least one of said suction port 111*a*, 211*a* and said exhaust port 11*b*, 111*b* in an axial direction as viewed in a direction perpendicular to axes 21*b*, 22*b* of said screw rotors 21, 22 is larger than a half of one pitch of each of the screw rotors 21, 22. Preferably, a maximum length of at least one of said suction port 111*a*, 211*a* and said exhaust port 11*b*, 111*b* in an axial direction as viewed in a direction perpendicular to axes 21*b*, 22*b* of said screw rotors 21, 22 is substantially equal to one pitch of each of the screw rotors 21, 22. At least one of said suction port 111*a*, 211*a* and said exhaust port 11*b*, 111*b* has a width larger than a distance between axes 21*b*, 22*b* of said screw rotors 21, 22.

What is claimed is:

1. A vacuum pump comprising:

a housing having a first side face, a second side face opposite from the first side face, and a rotor chamber between the first and second side face;

a pair of screw rotors in mesh with each other and rotably disposed in said rotor chamber to define a gas transfer chamber between an inner wall of said housing and grooves of said pair of screw rotors, each of said screw rotors having at least one thread extending at least 720 degrees therearound;

a suction port and an exhaust port, both communicatable with said transfer chamber, such that three sections are formed in said transfer chamber including a suction section in communication with said suction port, an exhaust section in communication with said exhaust port, and a transfer section therebetween through which gas is forced from the suction section to the exhaust section;

wherein said exhaust port is formed in said second side face.

2. A vacuum pump comprising:

a housing having a first side face, a second side face opposite from the first side face, and a rotor chamber between the first and second side face;

a pair of screw rotors in mesh with each other and rotably disposed in said rotor chamber to define a gas transfer chamber between an inner wall of said housing and grooves of said pair of screw rotors, each of said screw rotors having at least one thread extending at least 720 degrees therearound;

a suction port and an exhaust port, both communicatable with said transfer chamber, such that three sections are formed in said transfer chamber including a suction section in communication with said suction port, an exhaust section in communication with said exhaust port, and a transfer section therebetween through which gas is forced from the suction section to the exhaust section;

wherein said suction port is formed in said first side face.

3. The vacuum pump according to claim 2, wherein a length of at least one of said suction port and said exhaust port in an axial direction as viewed in a direction perpendicular to axes of said screw rotors is larger than a half of one pitch of each of the screw rotors.

4. The vacuum pump according to claim 2, wherein part of meshing portions of said screw rotors is exposed to an exterior of the vacuum pump through the exhaust port as viewed in a direction perpendicular to axes of the screw rotors.

5. The vacuum pump according to claim 4, wherein lowermost ends of the meshing portions of said screw rotors are exposed to the exterior of the vacuum pump through the exhaust port.

6. The vacuum pump according to claim 2, wherein part of meshing portions of said screw rotors is exposed to an exterior of the vacuum pump through the suction port as viewed in a direction perpendicular to axes of the screw rotors.

7. The vacuum pump according to claim 6, wherein uppermost ends of the meshing portions of said screw rotors are exposed to the exterior of the vacuum pump through the suction port.

8. The vacuum pump according to claim 2, further comprising: a trap disposed on or in the vicinity of the suction port.

9. The vacuum pump according to claim 2, wherein said suction port and said exhaust port are respectively formed in said first and second side faces.

10. The vacuum pump according to claim 2, wherein at least one of said suction port and said exhaust port has a width larger than a distance between axes of said screw rotors.

11. The vacuum pump according to claim 2, wherein a maximum length of said suction port in an axial direction as viewed in a direction perpendicular to axes of said screw rotors is substantially equal to one pitch of each of the screw rotors.

12. The vacuum pump according to claim 2, wherein at least one of said suction port and said exhaust port has substantially a polygonal shape as viewed in a direction perpendicular to axes of the screw rotors.

13. The vacuum pump according to claim 12, wherein at least one of said suction port and said exhaust port has substantially a pentagonal shape as viewed in the direction perpendicular to the axes of the screw rotors.

14. The vacuum pump according to claim 12, wherein at least one of said suction port and said exhaust port has a predetermined shape as viewed in the direction perpendicular to the axes of the screw rotors, and said predetermined shape includes a first inclined part extending substantially parallel to a direction in which said groove of one of said screw rotors extends, and a second inclined part extending substantially parallel to a direction in which said groove of the other of said screw rotors extends.

15. The vacuum pump according to claim 14, wherein said first inclined part is offset from said second inclined part in a direction parallel to a plane containing the axes of said screw rotors.

16. The vacuum pump according to claim 1, wherein a maximum length of said exhaust port in an axial direction as viewed in a direction perpendicular to axes of said screw rotors is substantially equal to one pitch of each of the screw rotors.

17. The vacuum pump according to claim 1, wherein at least one of said suction port and said exhaust port has substantially a polygonal shape as viewed in a direction perpendicular to axes of the screw rotors.

18. The vacuum pump according to claim 17, wherein at least one of said suction port and said exhaust port has substantially a pentagonal shape as viewed in the direction perpendicular to the axes of the screw rotors.

19. The vacuum pump according to claim 17, wherein at least one of said suction port and said exhaust port has a predetermined shape as viewed in the direction perpendicular to the axes of the screw rotors, and said predetermined shape includes a first inclined part extending substantially parallel to a direction in which said groove of one of said screw rotors extends, and a second inclined part extending substantially parallel to a direction in which said groove of the other of said screw rotors extends.

20. The vacuum pump according to claim 19, wherein said first inclined part is offset from said second inclined part in a direction parallel to a plane containing the axes of said screw rotors.

21. The vacuum pump according to claim 1, wherein a length of at least one of said suction port and said exhaust port in an axial direction as viewed in a direction perpendicular to axes of said screw rotors is larger than a half of one pitch of each of the screw rotors.

22. The vacuum pump according to claim 1, wherein part of meshing portions of said screw rotors is exposed to an exterior of the vacuum pump through the exhaust port as viewed in a direction perpendicular to axes of the screw rotors.

23. The vacuum pump according to claim 22, wherein lowermost ends of the meshing portions of said screw rotors are exposed to the exterior of the vacuum pump through the exhaust port.

24. The vacuum pump according to claim 1, wherein part of meshing portions of said screw rotors is exposed to an exterior of the vacuum pump through the suction port as viewed in a direction perpendicular to axes of the screw rotors.

25. The vacuum pump according to claim 24, wherein uppermost ends of the meshing portions of said screw rotors are exposed to the exterior of the vacuum pump through the suction port.

26. The vacuum pump according to claim 1, wherein said suction port and said exhaust port are respectively formed in said first and second side faces.

27. The vacuum pump according to claim 1, wherein at least one of said suction port and said exhaust port has a width larger than a distance between axes of said screw rotors.

* * * * *